US006652657B2

(12) United States Patent
Parrish et al.

(10) Patent No.: US 6,652,657 B2
(45) Date of Patent: Nov. 25, 2003

(54) METHOD FOR ELECTROCHEMICALLY TREATING ARTICLES AND APPARATUS AND METHOD FOR CLEANING ARTICLES

(75) Inventors: Robert B. Parrish, Waterford, MI (US); Christopher T. Shallow, West Hartford, CT (US)

(73) Assignee: United Technologies Corporation, Hartford, CT (US)

( * ) Notice: Subject to any disclaimer, the term of this patent is extended or adjusted under 35 U.S.C. 154(b) by 176 days.

(21) Appl. No.: 09/754,594

(22) Filed: Jan. 5, 2001

(65) Prior Publication Data

US 2002/0014255 A1 Feb. 7, 2002

Related U.S. Application Data

(60) Provisional application No. 60/221,771, filed on Jul. 31, 2000.

(51) Int. Cl.[7] ..... C25D 5/04; B08B 7/04

(52) U.S. Cl. ..... 134/1; 134/18; 134/22.12; 205/151

(58) Field of Search ..... 134/22.1, 22.11, 134/22.12, 1, 18; 204/157.15, 622, 471, 479, 272, 275.1, 273, 224 R, 224 M; 205/151

(56) References Cited

U.S. PATENT DOCUMENTS

| | | | | | |
|---|---|---|---|---|---|
| 3,905,885 | A | * | 9/1975 | Bengal | 204/272 |
| 4,246,088 | A | * | 1/1981 | Murphy | 204/199 |
| 4,303,481 | A | | 12/1981 | Mortier et al. | 204/25 |
| 4,436,594 | A | | 3/1984 | Nishida | 204/33 |
| 4,592,819 | A | | 6/1986 | Suzuki | 204/203 |
| 4,883,578 | A | * | 11/1989 | Jowitt et al. | 204/625 |
| 5,092,975 | A | | 3/1992 | Yamamura et al. | 204/198 |
| 5,176,803 | A | * | 1/1993 | Barbuto | 204/237 |
| 5,344,491 | A | | 9/1994 | Katou | 118/695 |
| 5,435,899 | A | * | 7/1995 | Gimenez et al. | 204/624 |
| 5,861,087 | A | * | 1/1999 | Manning | 204/272 |
| 5,873,986 | A | * | 2/1999 | Thompson | 204/237 |
| 6,267,855 | B1 | * | 7/2001 | Watanabe | 204/228.3 |
| 6,383,348 | B2 | * | 5/2002 | Kuroda | 204/224 M |

FOREIGN PATENT DOCUMENTS

| | | | |
|---|---|---|---|
| EP | 59481 A | 8/1982 | C25D/5/08 |
| JP | 59-028597 A | 2/1984 | C25D/17/00 |

OTHER PUBLICATIONS

Derwent Abstract Accession No. 93–271396/34, Class M11, SU1758092 (Perm Motorostroitel PRODN Assoc Aug. 30, 1992.

* cited by examiner

*Primary Examiner*—Alexander Markoff
(74) *Attorney, Agent, or Firm*—Gene D. Fleischhauer

(57) ABSTRACT

A method for performing electrochemical processes using an array of dedicated cells is disclosed. Various construction details and steps of the method are developed which promote, in one embodiment, automating the method of performing the processes and cleaning the articles between electrochemical processes. In one embodiment, the array of dedicated cells includes rinsing cells which have a rinse chamber adapted to receive an article and flow rinse fluid such that the fluid impinges against the article at predetermined locations.

12 Claims, 3 Drawing Sheets

FIG.2
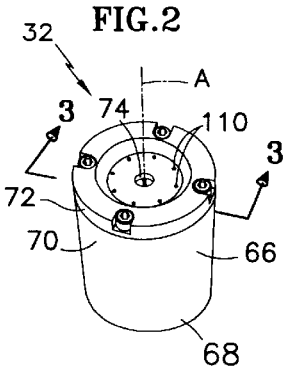
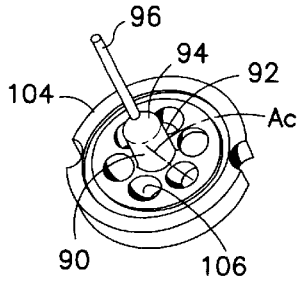
FIG.4
FIG.3
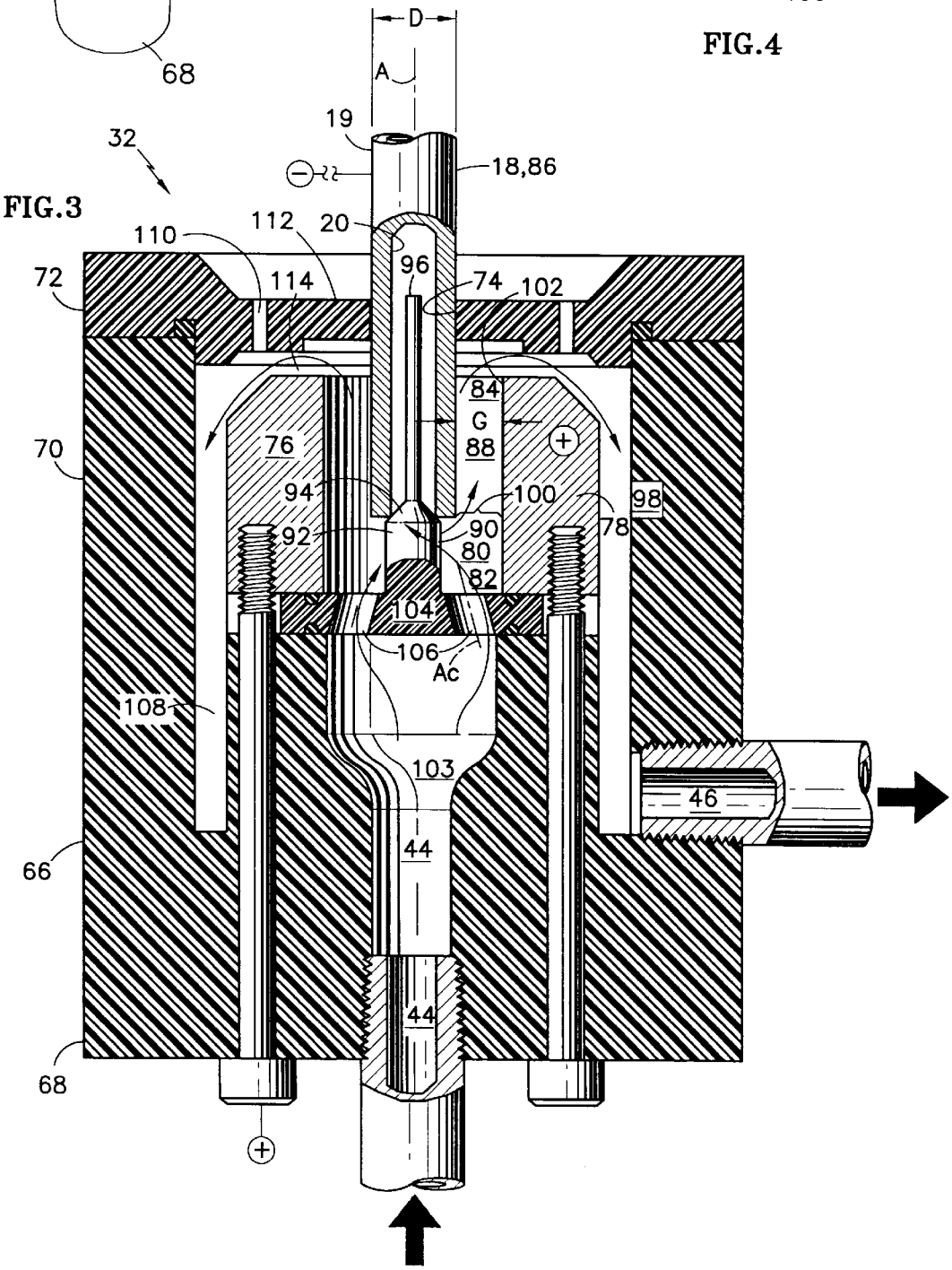

METHOD FOR ELECTROCHEMICALLY TREATING ARTICLES AND APPARATUS AND METHOD FOR CLEANING ARTICLES

CROSS-REFERENCE TO RELATED APPLICATIONS

This application claims benefit from U.S. Provisional Application Ser. No. 60/221,771 filed on Jul. 31, 2000.

The subject matter of this application is related to the subject matter of U.S. patent application Ser. No. 09/754,595 filed on even date herewith by Shallow et al. entitled "Method And Apparatuses For Electrochemically Treating An Article."

BACKGROUND OF THE INVENTION

1. Technical Field

This invention relates to a method for electrochemically processing articles, such as cylindrically shaped, hollow tubing articles, and more specifically, to methods and to apparatuses used for plating processes.

2. Background Information

One example of hollow articles requiring plating is tubing used in the aerospace field. The tubing is used for flowing fuel, lubricating fluid, hydraulic fluid and the like, typically in high-pressure applications. The tubing is relatively small in diameter (less than one inch) and is typically joined to a mating component using braze material. The tubing frequently receives a coating to provide a smooth surface. The coating is carefully applied because the coated tubing has controlled tolerances. The smooth surface and controlled tolerances ensure that capillary forces will urge the braze material to flow into a predetermined gap between the tubing and the component.

One approach for providing the coating uses a plating process having a large-scale bath and includes disposing many pieces of tubing in the bath. A large-scale plating bath may not efficiently use the plating solutions, increasing purchasing costs and increasing disposal costs of the environmentally sensitive waste. Depending on the location of the tubing in the bath, the tubing might receive a thicker than desired coating or a thinner than desired coating. In addition, a large-scale plating bath may well be located at a site remote from the location at which the brazing processes are carried out.

Another approach for providing the coating is a brush plating process. The electrolytes used for brush plating have a higher metal content than electrolytes for conventional plating baths. Brush plating processes employ a carbon anode wrapped in a conductive pad. The conductive pad is soaked in the electrolyte. This is essential to achieve higher rates of plating deposition. A current is passed through the pad and to the article as the operator rubs the pad over the surface.

An advantage of the brush plating process is little waste and acceptable levels of time for work in process. However the process is labor-intensive and variations in technique from operator to operator increase the difficulty of precisely controlling the plating thickness. In addition, the operator must handle harsh chemicals during cleaning and etching and must hold and move the anode with a repetitive motion that causes fatigue and which might cause repetitive motion injuries.

Accordingly, scientists and engineers working under the direction of Applicants Assignee have sought to develop a plating process and apparatus for use with such processes that provide efficient use of solutions, efficient use of rinsing water and may be installed in local work areas.

SUMMARY OF INVENTION

This invention is predicated in part on the recognition that using concentrated solutions of the type having higher metal content for use with high-speed plating may advantageously be used in local work areas by using dedicated plating cells. It is also predicated on recognizing that dedicated cells may be provided with flow patterns that promote rinsing processes and electrochemical processes associated with plating. Is also predicated on, in one embodiment, recognizing that such dedicated cells promote automation of the plating process. In this context, electrochemical processes refer to process steps for an article, such as etching, activating and electroplating and other steps that pass a current through an electrolyte. The current is passed between a pair of electrodes where the article acts as one of the electrodes, whether as an anode or a cathode. Rinsing refers to those steps using an apparatus to prepare the surface by removing contaminants from the surface with a rinse fluid, such as by removing electrolyte from the surface with rinse water.

According to the present invention, a method for electrochemically plating an article which requires at least two preparatory process steps and a plating process step includes the step of providing an array of cells which includes electrochemical cells, each electrochemical cell being dedicated to and containing during a step the necessary solutions for carrying out the step in the plating process, each electrochemical cell having a first dedicated electrode formed by an electrode attached to the cell and being of a size and having an interior for receiving a volume of fluid connected with that step which is appropriate for carrying out the process step on a single article at that cell; the step of adding to the cell a second dedicated electrode formed by the article; and, further includes the step of moving articles relative to the cells such that a single article moves in sequential fashion through the dedicated cells.

In accordance with one embodiment, the method includes flowing a volume of solution for performing the process step through the electrode of at least one of the dedicated cells.

In accordance with one detailed embodiment, the method includes moving an array of tubings sequentially through the dedicated cells such that a single tubing is at each cell as the process steps are being performed and wherein the duration of time at any dedicated cell is at least equal to the duration of time at that one dedicated cell requiring the longest amount of time for carrying out the process.

In accordance with one detailed embodiment, the method includes indexing the tubings of an array of tubings, each to an associated cell; moving the array of tubings with respect to the cells, each into an associated dedicated cell; performing the process step at the dedicated cell; removing the array of tubings from the dedicated cells; and, reindexing the tubings with respect the cells by moving the array of tubings together, each to the next dedicated cell, and further includes removing from the array of tubings, the tubing which has completed processing and adding a tubing to the array for beginning the method.

In one detailed embodiment, the method includes moving the tubing in sequential fashion through dedicated cells for performing the steps of electrochemical cleaning using an electrolytic fluid, rinsing using water, electrochemical etching using an electrolytic fluid, rinsing using water; electrochemical activating using an electrolytic fluid; electroplating using an electroplating solution, and, rinsing using water.

In one particular embodiment, the electrochemical cleaning solution is a base; the etching solution is an acid; the activating solution is sulfuric acid and ammonium sulfate; and the electroplating solution is a nickel plate solution.

In one detailed embodiment, the method includes using a data processing device to determine the duration of time that a tubing spends at a dedicated cell, which includes determining the amp-hours consumed, the volume of rinse fluid consumed between dedicated electrochemical cells; and determining the dedicated cell and tubing requiring the longest time and turning off the flow of fluid and current to the other cells as appropriate once the process step being performed at a dedicated cell is complete.

According to the present method, the step of rinsing a tubing includes disposing the tubing in a chamber having passages directed toward the chamber and further includes a guide member extending axially in chamber, the method further including the steps of sliding the tubing over the guide member; flowing a rinse fluid longitudinally through the guide member and radially outward through the guide member such that the fluid impinges on the interior of the tubing while simultaneously flowing fluid through the passages in the wall that are directed toward the tubing disposed in the center of the chamber under significant pressure, such as a pressure which is in excess of ten pounds per square inch gauge (10 psig) and in some applications is equal to fifteen pounds per square inch gauge (15 psig).

In accordance with the present invention, the step of flowing a rinse fluid includes the steps of detecting the presence of the tubing in the chamber; flowing a predetermined amount of rinse fluid to the chamber prior to flowing the rinse fluid through the pin and through the walls the chamber.

A primary feature of the present invention is a method which uses dedicated electrochemical processing cells in a plating process. In one embodiment, a feature is indexing and reindexing an array of articles with respect to the dedicated cells as the processes are performed in each cell. Another feature is forming a cell such that a first electrode forms at least a portion of electrode chamber within the cell. Another feature is disposing the article being processed in the electrode chamber to form to the second electrode. Still another feature is flowing electrolytic fluid through the electrode chamber under operative conditions. Still another feature is forming dedicated rinsing cells having passages for impinging rinse fluid against the article. Still another feature is a rinsing cell having a guide member which both positions the article in the rinsing cell and flows rinse fluid to the interior of the article to rinse away electrolytic fluid.

A primary advantage of the present invention is the efficiency of the process which results from using dedicated cells having small volumes of fluid for repetitively performing a plating operation that reduce waste and purchasing costs. Another advantage is the ability to use such cells in a small, local area. An advantage of the method is the convenience of having a plating apparatus in close proximity to an area which performs brazing. Another advantage is the efficiency that results from using the dedicated cells with devices that facilitate automation of the process.

The foregoing features and advantages of the present invention will become more apparent in light of the following detailed description of the best mode for carrying out the invention and accompanying drawings.

BRIEF DESCRIPTION OF THE DRAWING

FIG. 2 is a perspective view of an electrochemical cell for performing process steps involving passing current through the cell in a method of electroplating an article, such as a tubing;

FIG. 3 is a cross-sectional view of the electrochemical cell of FIG. 2 taken along the lines 3—3 of FIG. 2 and partially broken away for clarity;

FIG. 4 is a perspective view of a guide member of the electrochemical cell shown in FIG. 3;

DETAILED DESCRIPTION

Figure 1:
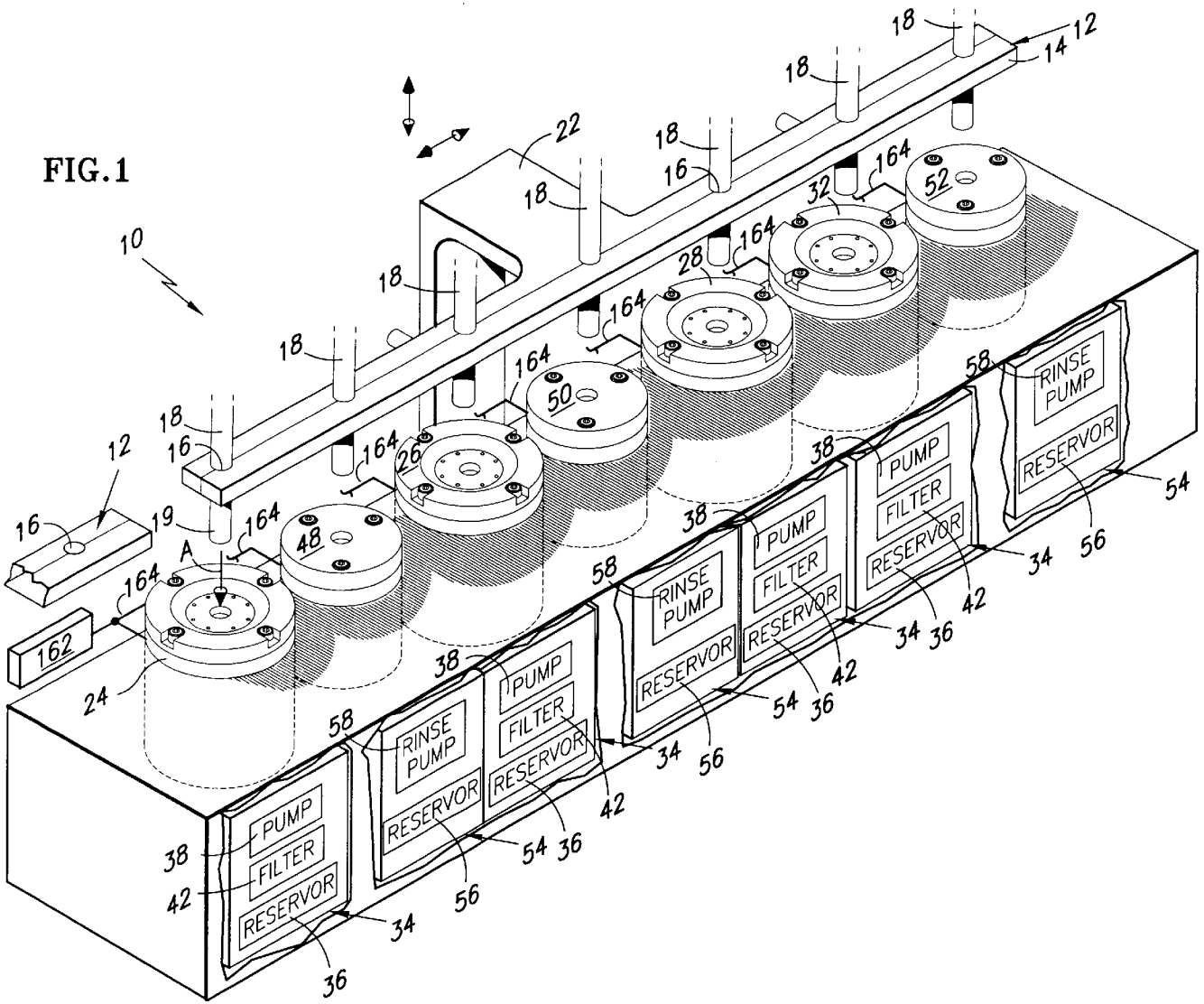
FIG. 1 is a perspective view of an apparatus for performing plating including a schematic illustration of an indexing device for moving a plurality of articles through the coating system indexing and reindexing the articles with respect to the electrochemical cells of the apparatus.

FIG. 1 is a perspective view of an apparatus 10 for performing electrochemical processes, such as a plating apparatus for applying nickel plate to tubing. FIG. 1 includes a schematic illustration on an indexing device 12 for moving a plurality of articles through the plating system. The indexing device includes one or more carriers, as represented by the horizontally extending carrier 14. Each carrier has a plurality of openings 16 which adapts the indexing device to receive a plurality of articles, such as a plurality of tubings 18. Each tubing has an outer wall 19 and an inner wall 20. The indexing device includes a support 22 which might engage a belt which carries the indexing device and provides for continuous movement of indexing devices through the apparatus.

As shown in FIG. 1, the plating apparatus 10 includes a plurality of cells for treating the articles, such as electrochemical cells and rinsing cells. The electrochemical cells for electrochemically treating the tubing are represented by the cells 24, 26, 28, 32. These cells are formed in the same manner and are each similar in design to the representative cell 32. Cell 32 is shown in FIG. 2 and FIG. 3 and is discussed below in more detail. Each electrochemical cell 24, 26, 28, 32 is in flow communication with means 34 for supplying electrochemical fluid, such as electrolytic fluid. Electrolytic fluid is commonly referred to as an "electrolyte". The means for supplying electrochemical fluid has a reservoir 36, a pump 38, a filter 42 for the electrolyte, and, as shown in FIG. 3, both a supply conduit 44 and a return conduit 46 for supplying the electrolyte and removing the electrolyte from the interior of the cell. In the embodiment shown, a portion of the supply conduit 44 and return conduit 46 are part of electrochemical cell and extend through the interior of the electrochemical cell.

Figure 6:
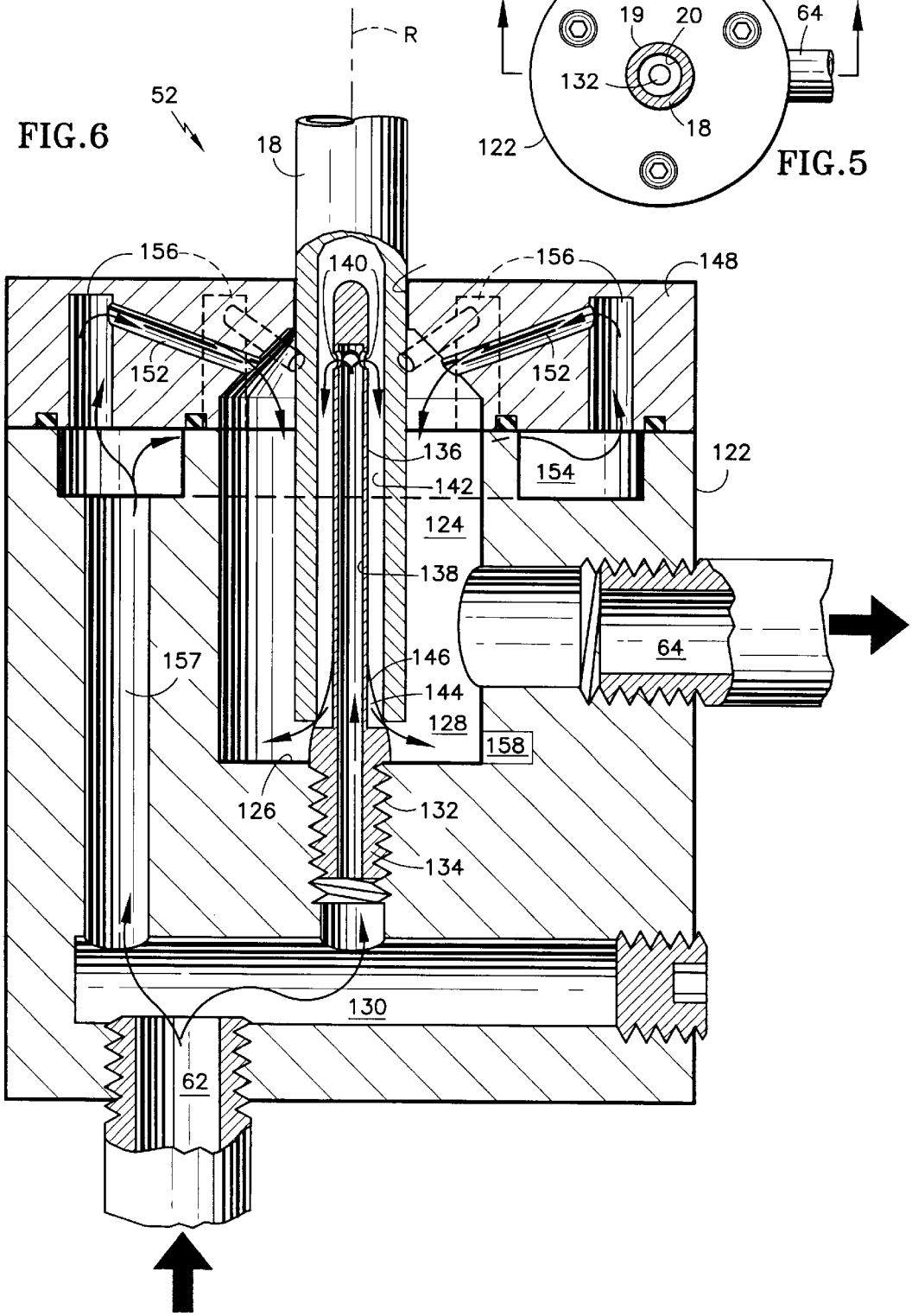
FIG. 6 is a cross-sectional view of the rinsing cell of FIG. 5 taken along the line 6—6 of FIG. 5 which is partially broken away for clarity, the rinsing cell being shown in an operative condition during rinsing of an article, such as a tubing.
Figure 5:
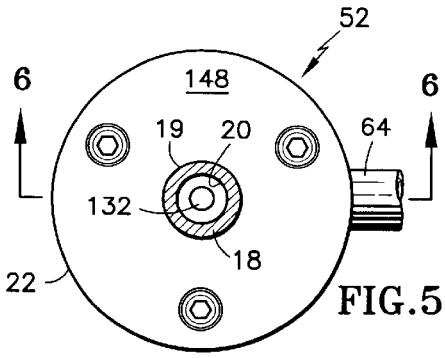
FIG. 5 is a view from above of a rinsing cell for performing a cleaning process step which includes flowing a predetermined amount of rinse fluid to the cell.

The plating apparatus 10 includes a plurality of rinsing cells, as represented by the rinsing cells 48, 50, 52, for cleaning the electrochemical fluid from the tubing as required. The rinsing cell is shown in FIG. 5 and FIG. 6 and is discussed in more detail below. Each rinsing cell is in flow communication with means 54 for supplying a rinse fluid, such as deionized water. The means includes a reservoir 56, a pump 58, a supply conduit 62 and, as shown in FIG. 5, a return conduit 64 for supplying and removing rinse fluid. In the embodiment shown in FIG. 6, a portion of the supply conduit 62 and return conduit 64 are part of the rinsing cell and extend through the interior of the rinsing cell. The return conduit is in flow communication with the reservoir 56 or might be in flow communication with a sump (not shown) for collecting the fluid for later disposal.

FIG. 2 is a perspective view of one of the electrochemical cells, such as plating cell 32. The electrochemical cell has an axis A and has an outer housing 66 having a base 68. The outer housing includes a wall 70 which extends circumferentially about the cell. The cell has a cap 72 having an opening 74 for receiving the tubing.

FIG. 3 is a cross-sectional view of the cell 32 taken along the line 3—3 of FIG. 2. The cross-sectional view is partially broken away for clarity. The electrochemical cell has a first electrode, as represented by the carbon-platinum electrode 76. The first electrode is commonly referred to as a carbon electrode or housing electrode. The first electrode has at least a portion, such as a wall 78, which extends circumferentially about the cell to form an electrode chamber 80 for receiving electrolyte. The electrode chamber has a first region, such as a bottom 82 of the electrode chamber; and a second region, such as the top 84 of the electrode chamber.

The electrode chamber 80 adapts the electrochemical cell to receive electrolyte and to receive a second electrode 86 of the electrochemical cell. The second electrode is the article being processed, such as the tubing 18 which has the outer wall 19 and the inner wall 20.

The second electrode 86 (or tubing 18) is disposed in the electrode chamber 80 under said operative condition. The second electrode is spaced radially from the first electrode leaving a gap G therebetween. The gap G extends about the perimeter of the electrochemical cell and forms and electrolyte passage 88. The gap G is circumferentially continuous but might be interrupted in alternate embodiments. The tubing has a hydraulic diameter D, which is four times the cross-sectional area, bounded by the perimeter of the tubing and divided by the perimeter of the tubing. In the embodiment shown, the hydraulic diameter was about four (0.4) tenths of an inch or about one (1) centimeter. They gap G was about two (0.2) tenths of an inch or about one-half of one centimeter (0.5 cm). Thus, the hydraulic diameter D is about twice the gap G.

The electrical circuit includes a power supply (not shown) for providing direct current to apparatus 10. Depending on the operation being performed, the tubing may be either the anode or the cathode of the electrical circuit that causes the electrochemical reaction. If the tubing is the anode, current flows away from the tubing. If the tubing is the cathode, current flows toward the tubing. In the embodiment shown, the tubing is the cathode.

FIG. 4 is a perspective view of a guide member 90 of the electrochemical cell. As shown in FIG. 3 and FIG. 4, the guide member is disposed in the electrode chamber 80 for guiding the tubing 18 as it enters the chamber. The guide member has a seat 92 having a tapered surface 94 facing outwardly in the axial direction. A pin 96 extends axially from the seat and is disposed in the electrode chamber 80. The pin adapts the guide member to position the tubing in the chamber as it enters and is disposed in the cell to avoid contact between the tubing and the electrode. The seat contacts the tubing at a predetermined location to ensure that the correct length of tubing has entered the chamber. A proximity sensor 98 confirms that the tubing is in its correct location.

As discussed above with FIG. 3, the annular passage 88 for electrolyte is bounded outwardly by the housing electrode 76 and inwardly by the pin 96; and after insertion of the tubing, inwardly by the tubing 18. The electrolyte passage has a first or supply opening, as represented by the annular supply opening 100. The electrolyte passage has a second or exhaust opening, as represented by the annular exhaust opening 102. The supply opening extends in flow communication with a source of electrolyte, as represented by the supply conduit 44. The supply conduit has a diffusion region 103 upstream of the annular supply opening 100. A swirler, as represented by the swirler 104, is disposed between the diffusion region and the supply opening of the electrolyte passage. The diffusion region slows the flow to reduce turbulence as the flow passes through the swirler and increases the static pressure of the flow prior to entering the swirler. Disposing the swirler between the diffusion region and the supply opening further spaces the sudden expansion of the diffusion region from the electrode chamber to ensure that unacceptable turbulence is not introduced into the flow.

The swirler 104 is attached to the seat 92 of the guide member 90 for centering the guide member in the electrode chamber 80. The swirler has a plurality of canted holes 106 or openings. The holes are an angle with respect to a plane containing the axis A. The holes impart a lateral or circumferential component of velocity to the electrolyte as the electrolyte flows in a generally axial direction through the swirler and thence through the electrolyte passage adjacent the tubing. The velocity is small enough to avoid cavitation and large enough to avoid other discontinuities in electrolyte concentration which might form because of the passage of the electrical current through the electrolyte. In the embodiment shown, the swirler is disposed between the electrode and adjacent structure of the electrochemical cell. In an alternate embodiment, for example, the swirler might be disposed entirely within the electrode chamber or disposed upstream of the electrode to such an extent that it is spaced axially from the electrode.

The return conduit 46 includes a collection chamber 108. The collection chamber is an annular chamber bounded by the wall 70 of the outer housing 66. The wall 70 extends circumferentially about and is radially spaced from the housing electrode 76. The collection chamber receives electrolyte exhausted from the electrolyte passage through the exhaust opening 102.

The cap 72 has return holes 110. These holes provide a passage for returning electrolyte to the cell 32 as the tubing is removed from the cell and drops of electrolyte fall from the tubing. The cap includes a plate 112 which is spaced axially from the housing electrode 76 leaving an overflow passage 114 therebetween. The overflow passage places the annular electrolyte passage 88 in flow communication with the collection chamber 108.

The opening 74 also constrains the tubing against radial movement as the tubing is moved axially into the electrochemical cell. Thus, the opening aligns the tubing with the pin 96 and also blocks the tubing from contacting the housing electrode 76. In alternate embodiments, the opening might have a conical shape so that the opening tapers in the axial inward direction to accommodate a degree of misalignment between the opening and the tube. In the present embodiment, either the opening 74 or the guide member 90 provides means for guiding the tubing, as the tubing is disposed in electrochemical cell. Thus, both the guide member 90 and the opening 74 in the cap cooperate to locate and constrain movement of the tubing 18 as it enters the electrochemical cell to block contact between the tubing and the cell which might otherwise cause a short-circuit.

As mentioned about the embodiment shown, the pin 96 is a sufficient length such that the opening 74 centers the tubing 18 on the guide member 90. Accordingly, the opening is not needed to constrain errant movement of the tubing which is already constrained by the guide member. In an alternate embodiment, the guide member might be eliminated by having an opening of sufficient axial length that the tubing is centered in the electrode chamber and engages a stop which corresponds to tapered surface 94 of the guide member.

During operation of the electrochemical cell 32, electrolyte is supplied to the bottom of the cell through the supply conduit 44. The electrolyte flows upwardly into the electrode chamber 80 with a slight circumferential velocity. This circumferential velocity does not create turbulence but does block the formation of regions of varying electrolyte concentration which might be induced by the flow of current through the electrolyte.

Flowing the electrolyte fluid vertically to the overflow passage enables a reasonably uniform removal of fluid from the circumference of the electrolyte passage. Flowing electrolyte fluid vertically and in a downward direction and removing the fluid through a single drain hole might introduce variations in concentration of the electrolyte which might adversely affect plating activity. In addition, the guide member is centrally disposed in the electrode chamber inside the article to be coated. As a result, the guide member does not interfere with the passage of current from the cathode to the anode by introducing a nonconductive material into the electrical field.

An advantage of the electrochemical cell is that small solution volumes are usable for processing a single tubing. This decreases environmental impact as compared to large plating tanks, producing smaller amounts of waste compared to large batch processing. The small size enables the cells to be located in a local area with acceptable lead-time and just in time production for producing parts. In addition, the quality of the plating system enabled maintaining tolerances that were smaller than a thousandth of an inch.

FIG. 5 is a view from above of the rinsing cell 52 with a tubing 18 installed in the rinsing cell. The rinsing cell is disposed about an axis of symmetry R. FIG. 6 is a cross-sectional view of the rinsing cell 52 taken along the line 6—6 of FIG. 5 with a portion of the rinsing cell partially in full and partially broken away for clarity. The rinsing cell has a wall 122 which extends circumferentially about the axis R to form a rinse chamber 124. The rinse chamber is bounded by an axially facing surface 126 and has a lower region or bottom 128. The supply conduit 62 includes a supply passage 130 for rinse fluid which is disposed in the cell and is in flow communication with the means 54 for supplying rinse fluid to the cell.

A guide member 132 is disposed in the rinse chamber 124 and extends axially in the chamber. In the embodiment shown, the guide member extends in the vertical direction. The guide member has a base 134 and a pin 136. An axially extending passage 138 for rinse fluid extends through the base and the pin. The guide member has a plurality of impingement holes 140. The impingement holes place the passage 138 of the pin in flow communication with the interior of the rinse chamber. In the operative condition, the tubing 18 is disposed about the guide member 132 and is spaced from the pin leaving an annular drain passage 142 therebetween. The tubing is disposed about the guide member such that impingement flow strikes the inside or inner wall 20 of the tubing. The impingement holes may be angled toward the bottom 128 of the rinse chamber to impart an axial component of velocity to the flow. The axial component of velocity decreases the effect that splash back from the impingement stream has on the flow. The vertical orientation of the drain passage causes gravity to urge the rinse fluid to flow downwardly along the inside of the tubing.

The base 134 of the guide member has a plurality of slots 144. The slots are spaced axially from the bottom of the rinse chamber. The slots are spaced circumferentially about the base leaving a seating surface 146 therebetween. The seating surface diverges axially to a diameter which is larger than the diameter of the inner wall of the tubing to locate the tubing in the axial (vertical) direction. The seating surface adapts the base member to engage the tubing at a line of contact. The line of contact is interrupted by the slots to permit drainage of the rinse fluid to the bottom of the chamber.

The rinsing cell has a cap 148. The cap has a hole 150 which adapts the cell to receive the tubing 18. The supply conduit 62 for rinse fluid includes other passages on the interior of the rinsing cell. For example, the cap has a plurality of radially directed impingement passages 152 in flow communication with the rinse chamber 124. The passages are directed toward the bottom of the rinse chamber to impart an axial component of velocity to the rinse flow. As with the interior of the tubing, the axial component of velocity decreases the effect that splash-back of rinse fluid impinging on the tubing has on flow to the bottom of the chamber. The cell includes a circumferentially extending plenum 154 which is in flow communication with the radially directed impingement passages and is, in turn, in flow communication through axial passages 156 and 144 with the supply passage 130 in the cell. The means 54 for supplying rinse fluid includes the supply conduit 62 and the return conduit 64 which are each in flow communication with the rinse fluid reservoir 56. As shown, the return conduit is spaced from the bottom of the rinse chamber. Alternatively, the return conduit may be in flow communication with the bottommost portion of the rinse chamber to completely drain rinse fluid from the rinse chamber.

An advantage of the rinsing cell is the controlled dispensing of rinse fluid, such as water, under pressure which produces a small amount of waste and the lower costs associated with waste disposal. In addition, automating the rinsing process minimizes operator fatigue and eliminates continuous movements by the operator of a rinsing device which might lead to repetitive motion injuries were one person to rinse a large volume of tubes moving through the assembly line on a daily basis.

During operation of the apparatus 10, the apparatus may be used by hand by eliminating the tubing carrier 14 or may use the tubing carrier with hand operation automatically with sensors. For example, the electrochemical cell and the rinsing cell might each have a proximity sensor, such as the inductive sensors 98, 158 which sense the presence of the tubing in the correct position in the cell. The sensor might rely on conductivity or inductivity of the tubing to trigger the sensor. In one embodiment, an inductive sensor was used which fits into the side of the housing. The inductive sensor triggers a relay timer. For the rinse system, the relay timer used is specifically set to a single shot mode for supplying the rinse fluid. Upon receiving a signal from the sensor, the timer closes a function circuit to provide a given duration of flow. Removing the tubing resets the system such that the timer can again be reactivated to provide rinse flow. The function circuit could be any conventional circuit such as, for example, one that is solenoid operated with a close center fluid control valve. The valve will allow flow of water to the rinse system when the tube is present and sensed by the inductive sensor.

During operation of the plating system 10, the first electrochemical cell 24 provides electrochemical cleaning to the tubing by flowing current toward the tubing, that is, the housing electrode is the anode and the tubing is the cathode. In one example involving the use of steel tubing and nickel plate on the tubing, the electroplating fluid was a sodium hydroxide base of about one (1) to five (5) percent sodium hydroxide by weight with the remainder as water. One satisfactory electrolyte is available from Sifco Industries, Cleveland, Ohio as Sifco Selectron Solution Code SCM 4100 electrolyte solution. Following a rinse cycle with water in the rinsing cell 48, the tubing is disposed in the second electrochemical cell 26 for etching. One satisfactory electrolyte is Sifco Selectron Solution Code SCM 4250, Activator No. 4 solution which is about five (5) to ten (10) percent by weight hydrochloric acid (HCl) with the balance water. Etching is provided by flowing current away from the tubing, that is, the housing electrode 76 of cell 26 becomes the cathode and the tubing becomes the anode. Following a second rinse cycle in rinsing cell 50, the tubing is disposed in the third electrochemical cell 28 for activating the surface of the tubing for plating. Activating is provided by flowing current toward the tubing, that is, the housing electrode becomes the anode and the tubing becomes the cathode. One satisfactory electrolyte is Sifco Selectron Solution Code SCM 4200, Activator No. 1 which is about five (5) to ten (10) percent sulfuric acid by weight; about seven (7) to thirteen (13) percent ammonium sulfate by weight with the remainder water. Finally, the tubing is removed from the activating electrochemical cell and moved directly to the plating cell 32 without rinsing. One satisfactory plating electrolyte is Sifco Selectron Solution Nickel Code SPS 5600. It is important that the activating solution not dry on the tubing before entering the plating cell.

During operation of the plating system 10, the method may be used automatically to treat a plurality of tubings 18 with electrochemical processes. The steps include forming an array of dedicated cells, that is, dedicated to performing a single process. The array of dedicated cells might be an array of electrochemical cells 24, 26, 28, 32 or an array of electrochemical cells 24, 26, 28, 32 and an array of rinsing cells 48, 50, 52 as shown. The array of cells is disposed with the cells in proximity one to the other such that their proximity enables relative movement of each tubing from one cell to the next, whether the next cell is an electrochemical cell or a rinsing cell.

In the embodiment shown, the tubings 18 are indexed to the dedicated cells 24, 48, 26, 50, 28, 32, 52 such that each tubing is aligned with the dedicated cell which is associated with the next process to be performed on the tubing. After the process is performed on the tubing, the array of tubings is reindexed such that each tubing moves to the next cell. A new tubing is added to the array and the finished tubing at the last cell is removed. As mentioned earlier, the electrolyte is flowed at a relatively steady rate in electrochemical cells and through the electrolyte passage 88 and from the cell. In rinsing cells, a predetermined amount of rinse fluid is supplied to the cell for each tubing that is processed. In one application, the amount of rinse fluid for each tubing was less than one ounce of fluid. The fluid is flowed from either type of cell during the process. In the rinsing cell, a small amount of rinse fluid may remain below the tubing in the bottom of the cell.

A data processing device 162, such as a computer, may be used with the array of cells 24, 48, 26, 50, 28, 32, 52 by being in signal communication with the cells through electrical conduits 164. This provides a data processing capability to the plating system 10. The data processing device may be programmed to calculate the duration of time that each tubing spends at each dedicated cell which necessarily determines the longest duration of time at each cell. The device causes each tubing to remain at its dedicated cell until the tubing requiring the longest processing time has completed its process. The data processing device turns off the process at the other cells as each process reaches its conclusion. Thus, the process may be automated with associated reductions in cost and materials.

Although the invention has been shown and described with respect to detailed embodiments thereof, it should be understood by those of ordinary skill that various changes in form and in detail thereof may be made without departing from the spirit and scope of the claimed invention.

We claim:

1. A method for electrochemically treating a plurality of tubings using at least two steps involving different electrochemical processes, each electrochemical process employing a first electrode and a second electrode for each tubing, each of the electrochemical processes having a steady-state operative condition during which an electrolyte is flowed at a flow rate about the tubing, comprising:

disposing an array of dedicated cells which includes an array of electrochemical processing cells in proximity one to the other to permit relative movement of each tubing in sequential fashion from dedicated cell to dedicated cell, each electrochemical processing cell being dedicated to performing an associated electrochemical process step and each electrochemical processing cell having the first electrode which bounds at least a portion of an electrode chamber for use in carrying out the electrochemical process and having an opening for removably receiving said tubing for forming the second electrode with said tubing;

moving the plurality of tubings relative to the array of dedicated cells such that each tubing moves in sequential fashion through the array of dedicated cells including disposing each tubing one after the other in the electrode chamber of said electrochemical processing cell by having the tubing extend from the exterior of the cell to the interior of the cell through the opening in the cell to removably form the second electrode;

disposing a volume of electrolytic fluid in the electrode chamber of each cell for performing one of said electrochemical process steps by flowing electrolytic fluid through the electrochemical cell, the flowrate of electrolytic fluid being flowed to the cell at any given time during the steady-state operative condition of the flow being about equal to the flowrate of electrolytic fluid being flowed through the electrode chamber at said given time for carrying out said associated electrochemical process step on a single tubing.

2. The method for electrochemically treating a plurality of tubings of claim 1 wherein the dedicated cells include a rinsing cell and wherein the method includes the step of disposing the rinsing cell next to one of said electrochemical processing cells, the rinsing cell being dedicated to processing a single tubing at any given time and wherein the method includes the step of disposing a tubing in the rinsing cell after said electrochemical processing cell and includes the process step of flowing a predetermined volume of rinse fluid under pressure through the rinsing cell for each tubing processed, and directing the predetermined volume of rinse fluid against the tubing to provide impingement cleaning of the tubing and includes moving each of the tubings to one of said adjacent dedicated cells which is associated with the next process step to be performed on the tubing.

3. The method for electrochemically treating a plurality of tubings of claim 2 wherein the step of moving each of said tubings is performed prior to complete drying of the fluid on the tubing.

4. The method for electrochemically treating a plurality of tubings of claim 2 wherein the step of disposing a volume of rinse fluid in the rinse chamber includes flowing a volume of rinse fluid for performing the process step to the rinse chamber, through the rinse chamber, and from the rinse chamber of said dedicated electrochemical processing cell.

5. The method for electrochemically treating a plurality of tubings of claim 2 wherein the tubing has a hydraulic diameter D and wherein the step of disposing the tubing in the electrode includes forming an annular gap G between the tubing and the first electrode which is smaller than said hydraulic diameter D, and includes passing electrolytic fluid through said gap G.

6. The method for electrochemically treating a plurality of tubings of claim 1 wherein the step of moving the plurality of tubings includes moving an array of tubings sequentially through the dedicated cells such that a single tubing is at each cell as the process steps are being performed, wherein each process step is performed for an associated duration of time, wherein the step of moving the plurality of tubings includes determining the longest duration of time for carrying out each process step and wherein the duration of time that a particular tubing remains at any dedicated cell is not less than the longest duration of time at that one dedicated cell requiring the longest duration of time for carrying out the process before moving the tubings to the next cell.

7. The method for electrochemically treating a plurality of tubings of claim 1 wherein the step of moving the tubing includes indexing the tubings of the array of tubings, each to an associated dedicated cell; moving the array of tubings with respect to the array of dedicated cells, each into an associated dedicated cell; performing the process step at the dedicated cell; removing the array of tubings from the dedicated cells; and, reindexing the tubings with respect the cells by moving the array of tubings together, each to the next dedicated cell, and further includes removing from the array of tubings, the tubing which has completed the last process step and adding a tubing to the array for beginning the method of treating said added tubing.

8. The method for electrochemically treating a plurality of tubings of claim 7 wherein the step of moving the plurality of tubings includes moving an array of tubings sequentially through the dedicated cells such that a single tubing is at each cell as the process steps are being performed, wherein each process step is performed for an associated duration of time, wherein the step of moving the plurality of tubings includes determining the longest duration of time for carrying out each process step and wherein the duration of time that a particular tubing remains at any dedicated cell is not less than the longest duration of time at that one dedicated cell requiring the longest duration of time for carrying out the process before moving the tubings to the next cell.

9. The method for electrochemically treating a plurality of tubings of claim 7 wherein the step of moving the tubing in sequential fashion through dedicated cells includes moving the tubing through dedicated cells for sequentially performing the steps of electrochemical cleaning using an electrolytic fluid, rinsing using water, electrochemical etching using an electrolytic fluid, rinsing using water; electrochemical activating using an electrolytic fluid; electroplating using an electrolytic electroplating fluid, and, rinsing using water.

10. The method of electrochemically treating a plurality of tubings of claim 9 wherein the method includes providing an electrochemical cleaning solution that is a base; providing an etching solution that is an acid; providing an activating solution that is sulfuric acid and ammonium sulfate; and providing an electroplating solution that is a nickel plate solution.

11. The method for electrochemically treating a plurality of tubings of claim 6 wherein the step of determining the longest duration of time at each dedicated cell includes using a data processing device to determine the duration of time that a tubing spends at a dedicated cell, and further includes determining the amp-hours consumed, the volume of rinsing fluid consumed between dedicated electrochemical cells; and determining the dedicated cell and tubing requiring the longest time and turning off the flow of fluid and current to the other cells as appropriate once the process step being performed at a dedicated cell is complete.

12. A method for electrochemically plating a plurality of tubing using electrochemical processes for the tubing which requires at least two preparatory process steps and a plating process step, comprising:

providing a plurality of cells, each electrochemical cell having an opening under the steady-state operative condition for removably receiving the tubing, each electrochemical cell being dedicated to and containing during a step the associated solutions for carrying out the associated step in the plating process, each electrochemical cell having a first-electrode and a second electrode formed by the tubing by having the tubing extend from the exterior of the cell to the interior of the cell through the opening in the cell to removably form the second electrode, wherein the first electrode is circumferentially disposed about the tubing and has an interior having a size for receiving the tubing and a volume of fluid connected with that step which is appropriate for carrying out the process step on a single tubing at that cell; flowing a volume of fluid connected with that step to the cell and from the cell which is appropriate for carrying out the process step on a single tubing at that cell; and moving the tubings relative to the cells such that a single tubing moves in sequential fashion through the dedicated cells.

* * * * *